United States Patent [19]

DeTray

[11] 4,043,081

[45] Aug. 23, 1977

[54] DRY LAP POLISHER

[76] Inventor: Donald E. DeTray, 10430 Truman Road, Independence, Mo. 64052

[21] Appl. No.: 716,064

[22] Filed: Aug. 19, 1976

[51] Int. Cl.[2] ..... B24B 37/04

[52] U.S. Cl. ..... 51/129

[58] Field of Search ..... 51/129, 131, 109 R, 51/12 S, 404; 125/3, 30

[56] References Cited

U.S. PATENT DOCUMENTS

| | | | |
|---|---|---|---|
| 970,227 | 9/1910 | Homan | 51/131 |
| 2,740,239 | 4/1956 | Ball | 51/404 |
| 2,772,521 | 12/1956 | Voytech | 51/129 |
| 2,870,580 | 1/1959 | Norton | 51/131 |
| 2,984,052 | 5/1961 | Mueller | 51/404 |
| 3,034,266 | 5/1962 | Grubb | 51/404 |
| 3,111,791 | 11/1963 | Harris | 51/129 |
| 3,267,618 | 8/1966 | Giezentanner | 125/30 R X |
| 3,377,750 | 4/1968 | Day | 51/131 |

FOREIGN PATENT DOCUMENTS

| | | | |
|---|---|---|---|
| 625,398 | 8/1961 | Canada | 51/131 |

*Primary Examiner*—Al Lawrence Smith
*Assistant Examiner*—Nicholas P. Godici
*Attorney, Agent, or Firm*—Fishburn, Gold & Litman

[57] ABSTRACT

A material polishing device for substantially dry polishing of flat items, such as rock slabs, mineral samples, geode sections, and the like, includes a support structure having a drive means mounted thereon for rotating a circular, planar table having a polishing member mounted on the table and rotatable therewith. A plurality of standards are mounted on the support structure and support thereon material holding means for retaining the flat items or material to be polished in engagement with the polishing member.

7 Claims, 8 Drawing Figures

DRY LAP POLISHER

The present invention relates to material polishing devices and more particularly to a material polishing device for substantially dry polishing of flat items and having means for retaining the material to be polished in engagement with a polishing member on a rotating table.

The principal objects of the present invention are: to provide a material polishing device for substantially dry polishing of flat items, such as rock slabs, mineral samples, geode sections, and the like to show the texture and design of the polished surface; to provide such a material polishing device wherein dust of the item being polished cooperates with the grit of a polishing member to polish the surface of the item; to provide such a material polishing device capable of polishing large surfaces, such as flat surfaces of geode sections; to provide such a device having means to cushion movement of the items during polishing thereof; and to provide such a material polishing device which is economical to manufacture, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the material polishing device.

Figure 1:
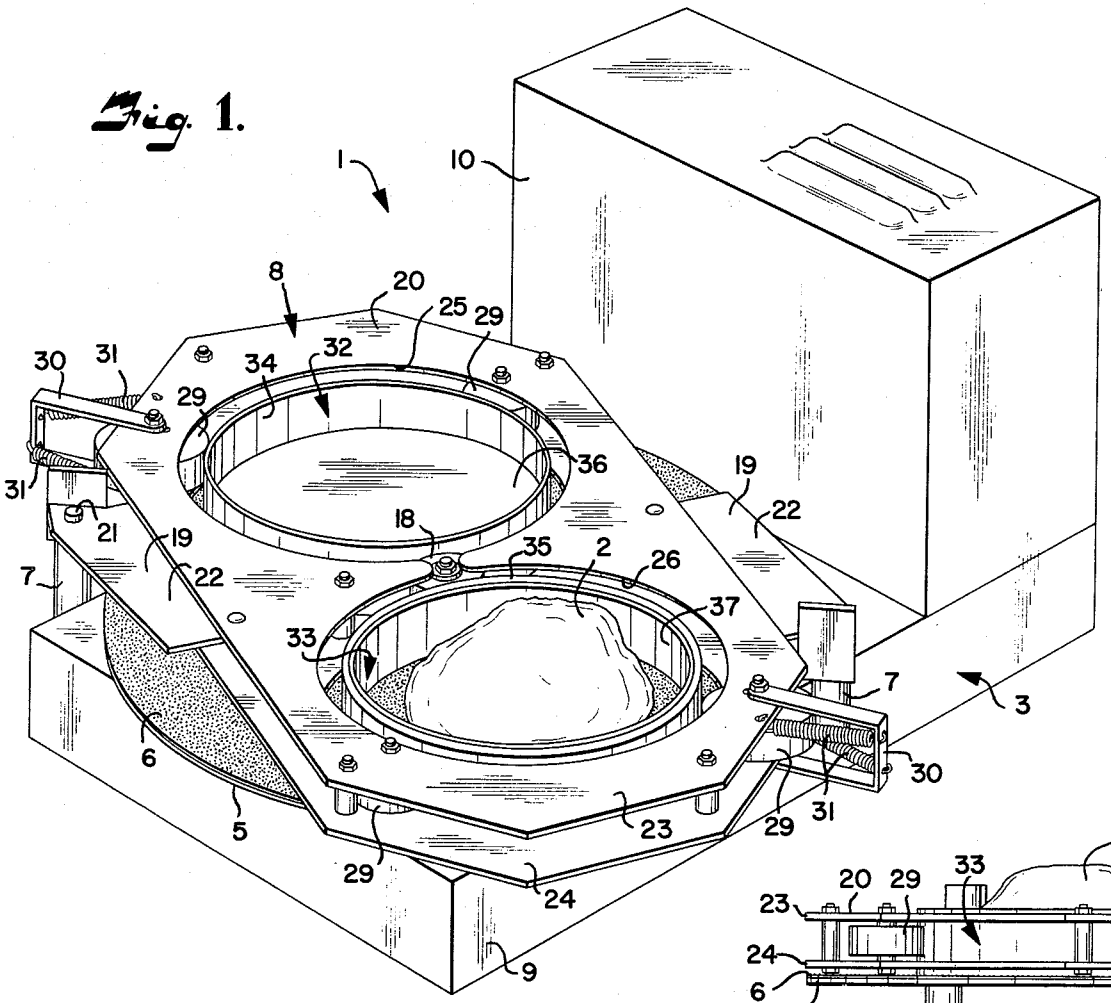
FIG. 1 is a perspective view of a material polishing device embodying features of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a material polishing device for substantially dry polishing of flat items 2, such as rock slabs, mineral samples, geode sections, and the like. the material polishing mechanism includes a flat rotating member that has a suitable grit adhered or otherwise secured relative thereto and means for retaining an item to be polished so that as the grit member is rotated, the item to be polished has the face thereof positioned on the grit member and is movable thereon in response to rotation of the grit member. The grit member may have various forms, but preferably is in the form of a rotating disc with a grit coating on the upper face thereof so the item to be polished rests thereon, the rotating mechanism may be any suitable driving means that will turn the disc at a suitable circumferential speed.

The material polishing device 1 illustrated includes a support structure 3 having drive means 4 mounted thereon for rotating a circular planar table 5 having a polishing member 6 mounted on the table 5 and rotatable therewith. A plurality of standards 7 are mounted on the support structure 3 and support thereon material holding means 8 for retaining the flat items or material to be polished in engagement with the polishing member 6.

The support structure 3 may be any suitable structure capable of supporting the table 5, standards 7, and drive means 4. The illustrated support structure 3 includes a frame 9 with a housing 10 extending upwardly from one end portion of the frame 9. The housing 10 encloses a suitable drive motor 11 operative to rotate the table 5.

The standards 7 are mounted on the support structure 3 and are positioned adjacent the periphery of the table 5. In the illustrated embodiment, the material polishing device 1 includes a pair of standards 7 mounted on the support structure 3 and positioned in diametrically opposed relation to the center of the table 5 and on opposite sides of the table 5. The upper end portion of each of the standards 7 has means defining an upwardly open recess 12 therein, for supporting the material holding means 8 as later described.

The drive means 4 includes any suitable components operative to rotate the table 5. In the illustrated embodiment, the drive motor 11 has a drive shaft with a suitable power transmitting member 14 thereon, such as a pulley or sprocket. The table 5 has an axle 15 with one end portion thereof rotatably supported on the support structure 3. The axle 15 has the table 5 mounted thereon and has a suitable power transmitting member 16 thereon, such as a pulley or sprocket. An endless member 17, such as a belt or chain, extends around the power transmitting members 14 and 16 on the motor drive shaft and the axle 15 respectively whereby the drive motor 11 is operative to rotate the table 5.

The axle 15 extends through the table 5 and has a generally circular center member 18 mounted thereon and in spaced relation with the upper surface of the polishing member 6. The center member 18 preferably has a resilient exterior surface, for a purpose later described.

The polishing member 6 may be any suitable material with a grit or abrasive suitably applied to a face thereof. In the structure illustrated, a mesh fabric having a suitable polishing grit or abrasive impregnated therein is adhered to the surface of the member 6. It has been found that a suitable polishing member is in the form of a disc of 12 to 20 inches in diameter and rotated at from a speed of 250 R.P.M. to 350 R.P.M. The rotation effects a speed of approximately 330 feet per minute at center of the respective holding means 8. The grit and fabric may vary and an example is a 180 mesh cloth with aluminum oxide or similar particles adhered thereto. A suitable abrasive is manufactured and sold by Minneapolis Mining and Manufacturing Company under the name "Wet or Dry Fabricut." It has been found that as the grit or abrasive cuts or grinds the surface of the material being polished that dust particles of the material fills the voids between the grit or abrasive of the polishing member 6 and thereby assists in polishing the respective surface.

The initial cuts by the grit or abrasive are substantially greater or deeper than later cuts by the grit or abrasive and become successively shallower as polishing continues. The grit or abrasive has spaces or interstices therebetween and the spaces are gradually filled as less and less of the grit or abrasive is exposed until the dust particles from the surface of the item 2 being polished is substantially level or flush with the tips of the grit or abrasive so that the major portion of the material of the polishing member 6 becomes fine particles of the item 2 being polished. The dust removed from the surface of the item 2 being polished thereby cooperates with the grit or abrasive in providing a fine cut and in polishing said surface.

Each of the standards 7 has a bracket 19 mounted thereon for supporting a frame 20 of the material holding means 8, as later described. The brackets 19 each have a pin 21 received in the recess 12 of a respective one of the standards 7 and a generally planar portion 22 extending from the respective standard 7. The planar portion 22 of each of the brackets 19 is substantially horizontal and positioned above and substantially parallel with the upper surface of the table 5 and the polishing member 6 thereon.

The frame 20 of the material holding means 8 is formed of a plurality of generally parallel plates 23 and 24 mounted in spaced apart relation, as by suitable spacers. The planar portion 22 of the brackets 19 are each positioned between the plates 23 and 24 of the frame 20 and the plates 23 and 24 are suitably secured to the brackets 19 so that the frame 20 is above and in covering relation with the upper surface of the table 5.

The plates 23 and 24 of the frame 20 have a pair of aligned apertures 25 and 26 therein for receiving holder members, as later described. The frame 20 has a plurality of rollers 29 mounted on the frame 20 and positioned between the plates 23 and 24. The rollers 29 are arranged in respective groups with the rollers 29 in each group being circumferentially spaced around the periphery of a respective one of the apertures 25 and 26. The rollers 29 each have a portion of the periphery thereof extending into the respective frame aperture.

The frame 20 has a center opening therein positioned between the apertures 25 and 26 so that the frame 20 may be positioned with the center member 18 in the frame center opening and with respective portions of the center member 18 extending into the frame apertures 25 and 26 and engageable with the material to be polished or the material holding means 8, as later described.

The material polishing device 1 includes means resiliently mounting selected ones of the rollers 29 mounted on the frame 20 so that the resiliently mounted rollers urge the material or the material holding means 8 toward the center roller or member 18.

In the illustrated embodiment, opposite corners of the frame 20 have aligned slots in the plates 23 and 24 wbich receive therein an axle of the respective rollers 29. A generally U-shaped mounting member 30 for each resiliently mounted roller 29 has arm portions thereof connected to opposite ends of the roller axle and the mounting members 30 each have a connecting portion extending between the arms and spaced outwardly from the frame 20. A pair of resilient members 31 for each mounting member 30 extend between and have opposite ends thereof connected to the connecting portion of the mounting member 30 and to the plates 23 and 24 respectively of the frame 20 whereby the resilient members 31 urge the respective mounting member and roller axle toward the end of the respective slots adjacent the respective aperture in the frame 20.

The illustrated material holding means 8 includes holder members 32 and 33 received in the apertures 25 and 26 respectively of the frame 20. The holder members 32 and 33 have respective wall means 34 and 35 thereof engageable with the rollers 29 and the center member or roller 18. The holder members 32 and 33 retain the flat items or material to be polished within the respective frame aperture and in engagement with the polishing member 6.

In the illustrated embodiment, one of the holder members, for example the holder member 32, has a bottom wall 36 connected to the side wall member 34 thereof. The bottom wall 36 has a lower surface capable of having material to be polished secured, thereon, particularly large rock flats or slices.

The other holder member 33 is illustrated as an annular or ring member having a cushion member 37 mounted on an interior surface of the wall member 35 thereof. The cushion member 37 is engageable by material to be polished during movement of the material within the holder member 33 in response to rotation or turning of the table member 5. The holder member 33 is, therefore, particularly adapted for polishing the end surface of a geode section. The holder members 32 and 33 are interchangeable and the polishing devices may be operated with two members 32 or two members 33 or with one of either or with both types of holders.

Figure 2:
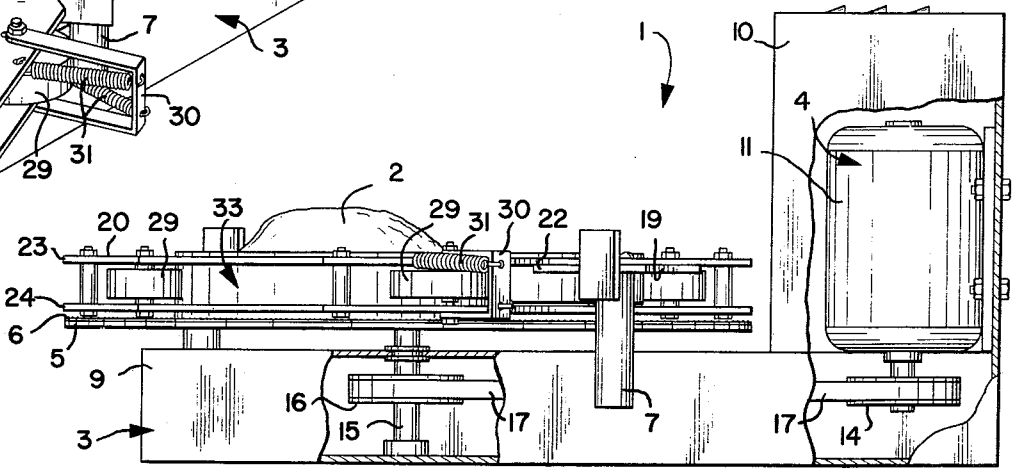
FIG. 2 is a side elevational view of the material polishing device with portions broken away to better illustrate the component parts.
Figure 5:
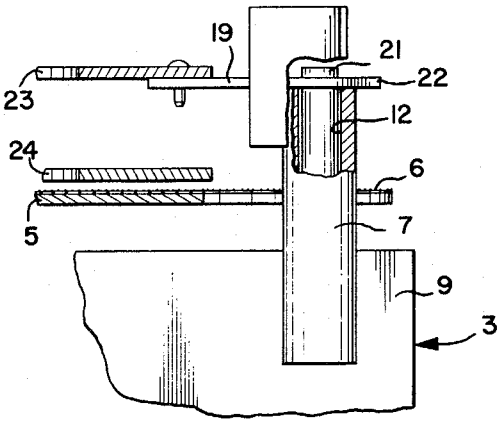
FIG. 5 is an enlarged fragmentary transverse sectional view taken on line 5—5 of FIG. 3 and showing mounting of the frame on a support structure.
Figure 6:
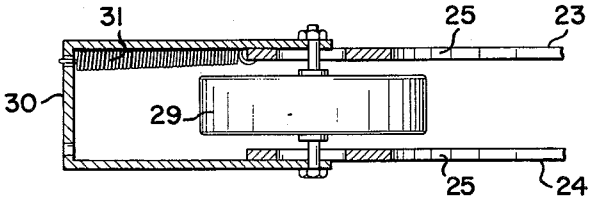
FIG. 6 is an enlarged fragmentary transverse sectional view taken on line 6—6 of FIG. 3 and showing resilient mounting of selected rollers.
Figure 4:
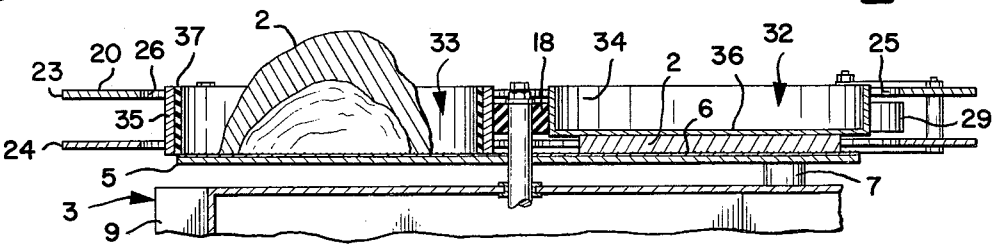
FIG. 4 is a fragmentary transverse sectional view taken on line 4—4 of FIG. 3 and showing a frame and material holder members for retaining flat items to be polished.
Figure 3:
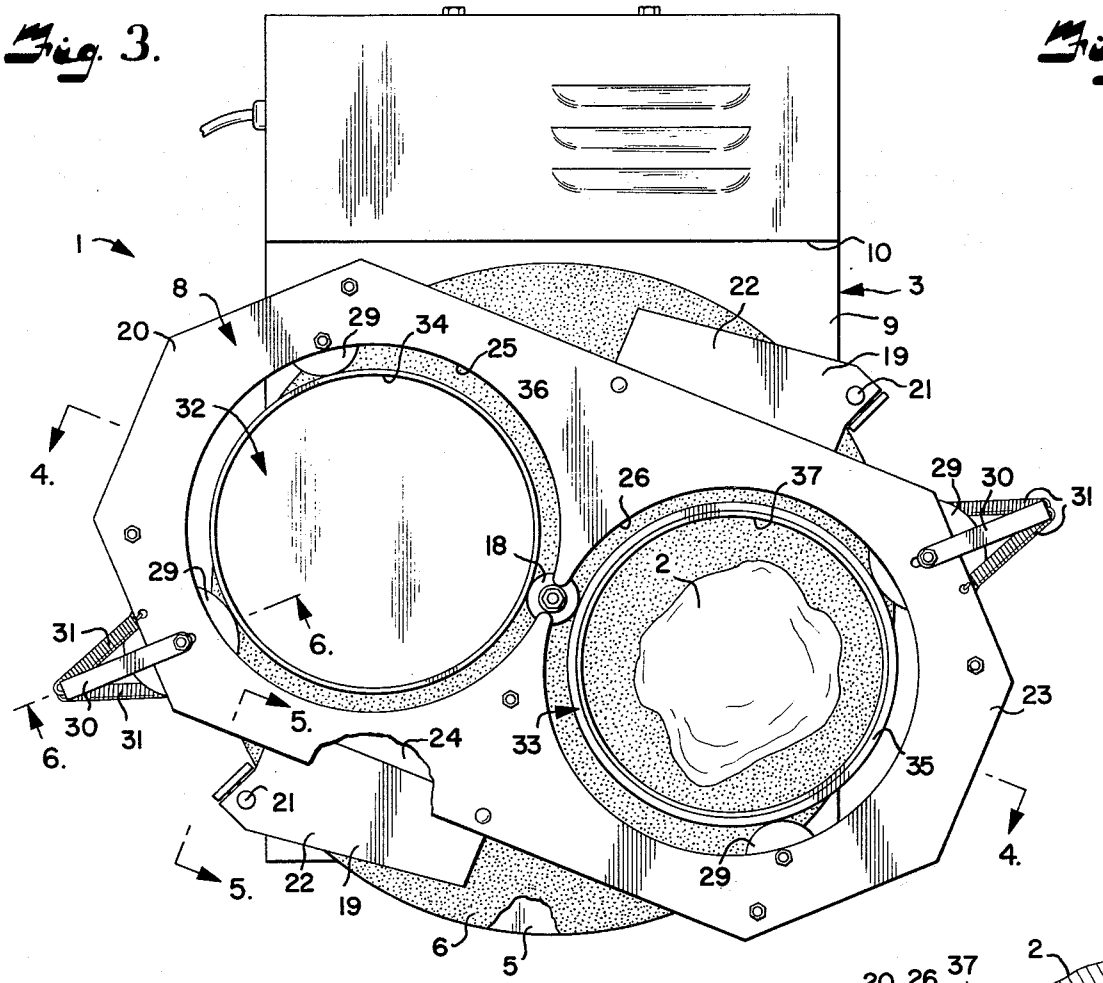
FIG. 3 is a top plan view of the material polishing device with portions broken away to better illustrate component parts.
Figure 8:
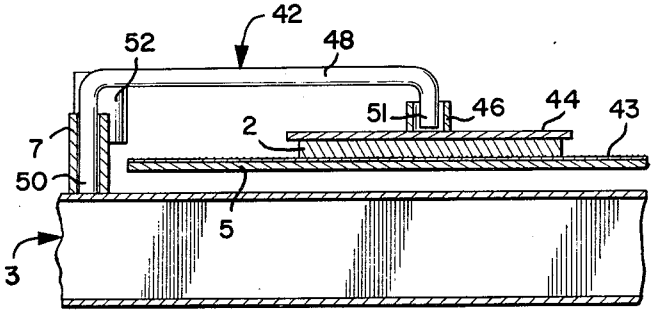
FIG. 8 is a fragmentary transverse sectional view taken on line 8—8 of FIG. 7 and showing swingable mounting of discs supporting thereon material to be polished.
Figure 7:
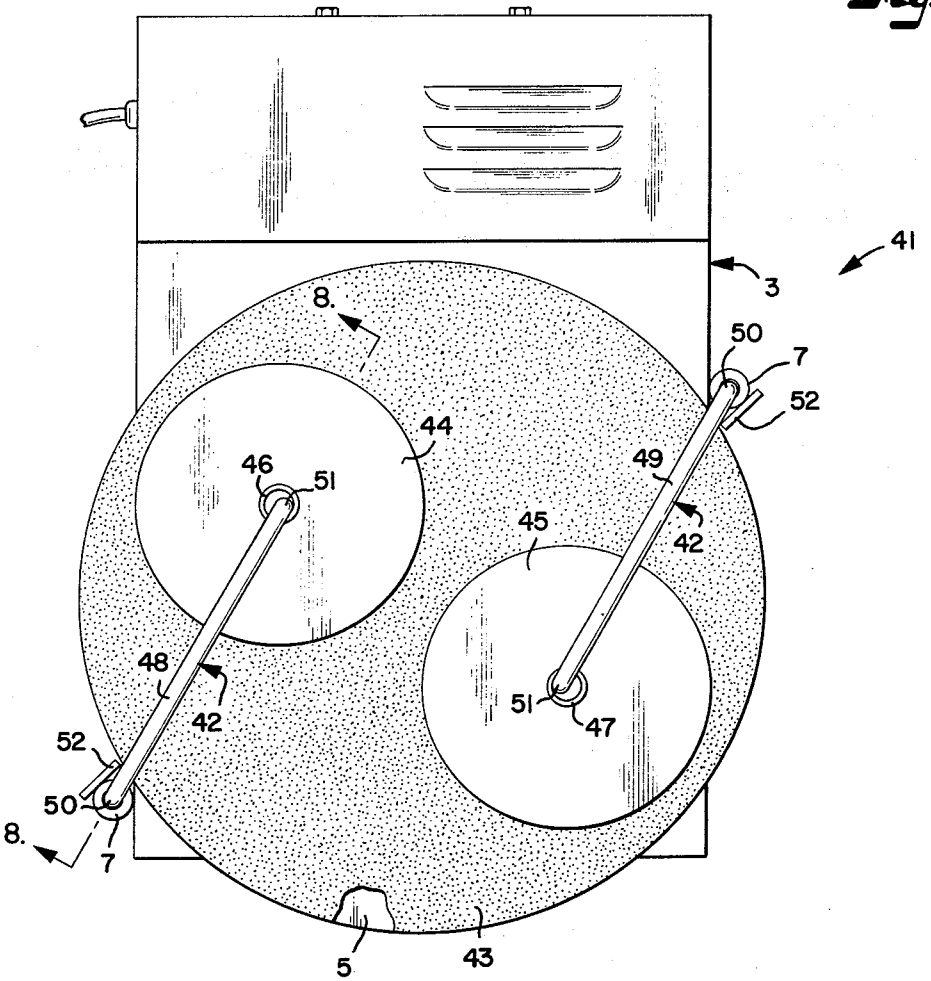
FIG. 7 is a top plan view of a modified form of the material polishing device.

FIGS. 7 and 8 illustrate a modified material polishing device 41 which includes the support structure 3, drive means 4, table 5, and the standards 7 as illustrated in FIGS. 1 to 3 inclusive. The table 5 does not have a center member or roller 18 and the modified material polishing device 14 does not have the frame 20 or the holder members 32 and 33 therefor. The modified material polishing device 41 has material holding means 42 supported on the standards 7 and extending over a polishing member 43 mounted on the table 5. The material holding means 42 is particularly adapted for holding or retaining flat items or material to be polished in engagement with the polishing member 43 during rotation of the table 5.

In the illustrated embodiment, a pair of generally circular planar discs 44 and 45 are positioned in overlying relation with the polishing member 43. The discs 44 and 45 each have a lower or bottom surface thereof capable of having large flat items 2 secured thereon. The discs 44 and 45 each have an upper surface and sockets 46 and 47 are formed on the upper surface of the discs 44 and 45 respectively.

A pair of arms 48 and 49 each have one end portion 50 thereof received in the recess 12 in the upper end of a respective one of the standards 7. The arms 48 and 49 each have an other end portion 51 thereof received in the sockets 46 and 47 on the upper surface of the discs 44 and 45 respectively whereby the discs 44 and 45 and the flat items 2 to be polished secured thereon are each moved by rotation of the table 5. The arms 48 and 49 extend radially from the respective standards 7. The end portions 50 and 51 of the arms 48 and 49 are smaller than the recesses 12 in the standards 7 and smaller than the opening in the sockets 46 and 47 on the discs 44 and 45 whereby the discs 44 and 45 may rotate about the other end portion 51 of the arms 48 and 49 and the arms 48 and 49 may swing about the standard 7 while the discs 44 and 45 are rotating or turning thereby providing a continual movement of the work being polished so the face will have contact with the different portions of the polishing member.

It is, therefore, desirable to prevent the discs from being moved off the table 5. A stop or abutment member 52 is mounted on each standard 7 and each stop or abutment member 52 is positioned to be engaged by the respective arm to retain the discs on the table 5 and the flat items 2 to be polished in engagement with polishing member 43.

The polishing member 43 is preferably formed of the same material as the polishing member 6. The initial cuts by the grit or abrasive are substantially greater or deeper than later cuts by the grit or abrasive and become successively shallower as polishing continues until the interstices between the grit or abrasive are filled. The polishing member 43 is then capable of use until the grit or abrasive is worn from the surface of the polishing member 43.

It is to be understood that while I have illustrated and described certain forms of my invention, it is not to be limited to these specific forms or arrangement of parts herein described and shown.

I claim:

1. A material polishing device comprising:

a. a support structure;

b. a circular planar table rotatably mounted on said support structure, said table being substantially horizontal and having an upper surface;

c. drive means mounted on said support structure and operatively connected to said table for rotating same;

d. a polishing member mounted on the upper surface of said table and rotatable therewith, said polishing member having a substantially flat upper surface with grit for cutting and polishing material;

e. a plurality of standards mounted on said support structure and positioned adjacent said table;

f. means supported on said standards and extending over said polishing member for retaining material to be polished and maintaining same in engagement with said grit on said polishing member and permitting rotation of the material to be polished during rotation of said table;

g. said standards each include means defining an upwardly open recess therein;

h. said standards each include a bracket having a portion thereof received in said upwardly open recess and extending laterally from said respective standard; and i. said means for retaining material to be polished and maintaining same in engagement with said polishing member includes:

1. a frame mounted on said brackets on said standards, said frame having a plurality of apertures therein;

2. a plurality of rollers mounted on said frame and arranged in respective groups with the rollers in each group circumferentially spaced around the periphery of a respective aperture; and 3. a plurality of holder members each received in a respective one of said frame apertures and each having a wall member engageable with said rollers for retaining material to be polished within said respective aperture and in engagement with said polishing member.

2. A material polishing device as set forth in claim 1 wherein at least one of said holder members includes a bottom wall member connected to said first named wall member of said holder member and having a lower surface capable of having material to be polished secured thereon.

3. A material polishing device as set forth in claim 1 wherein at least one of said holder members includes cushion means on an interior surface thereof and engageable by material to be polished during movement thereof within said holder member in response to rotation of said table.

4. A material polishing device as set forth in claim 1 including a center roller mounted on said table and rotatable therewith and having respective portions thereof engageable by said holder members in each of said frame apertures.

5. A material polishing device as set forth in claim 4 including means resiliently mounting selected ones of said rollers mounted on said frame for urging same and a respective holder member in engagement with said selected rollers toward said center roller on said table.

6. A material polishing device comprising:

a. a support structure;

b. a circular planar table rotatably mounted on said support structure, said table being substantially horizontal and having an upper surface, said table having a center member mounted on the upper surface and rotatable therewith;

c. drive means mounted on said support structure and operatively connected to said table for rotating said table and center member;

d. a polishing member mounted on the upper surface of said table and rotatable therewith;

e. a plurality of standards mounted on said support structure and positioned adjacent said table, said standards each having a bracket mounted thereon and extending outwardly therefrom;

f. a frame mounted on said brackets on said standards, said frame being in overlying relation with said table and having a plurality of apertures therein each having a respective portion of said center member extending thereinto;

g. a plurality of rollers mounted on said frame and arranged in respective groups with the rollers in each group circumferentially spaced around the periphery of a respective aperture; and h. a plurality of holder members each received in a respective one of said frame apertures and each having a wall member engageable with said rollers for retaining material to be polished within said respective aperture and in engagement with said polishing member, said holder members each being in engagement with said center member.

7. An apparatus for dry polishing a flat face on a rock section comprising:

a. a support structure;

b. a circular planar table rotatably mounted on said support structure, said table having an upper surface with a center and outer edge;

c. drive meams mounted on said support structure and operatively connected to said table for rotating same; and d. a polishing member mounted on the upper surface of said table and rotatable therewith for receiving a rock with a face to be polished in contact therewith;

e. means supported on said support structure outwardly of said planar table and having portions extending thereover for restricting area of movement of said rock whereby said rock is retained on the polishing member between the table center and outer edge and is free to rotate relative to said table and polishing member thereon; and f. said polishing member being a mesh material having abrasive grit in particles adhered thereto with interstices therebetween for receiving dust removed from said rock being polished, said dust and said grit cooperating as said rock is progressively polished whereby the polishing operation is characterized by the cutting by said grit being coarse during initial stages and being gradually finer as said interstices receive and fill with said dust reducing exposure of the grit to provide a fine polishing member when said interstices are substantially filled.

* * * * *